US006805144B2

(12) United States Patent
Usui et al.

(10) Patent No.: US 6,805,144 B2
(45) Date of Patent: Oct. 19, 2004

(54) PROTECTIVE COVER FOR UMBRELLAS AND UMBRELLA WITH THE PROTECTIVE COVER FIXED THERETO

(75) Inventors: Shoichiro Usui, Sendai (JP); Masayoshi Usui, Numazu (JP); Kikuo Asada, Mishima (JP)

(73) Assignee: Usui Kokusai Sangyo Kaisha Limited, Shizuoka Prefecture (JP)

( * ) Notice: Subject to any disclaimer, the term of this patent is extended or adjusted under 35 U.S.C. 154(b) by 104 days.

(21) Appl. No.: 10/164,168

(22) Filed: Jun. 5, 2002

(65) Prior Publication Data

US 2003/0019514 A1 Jan. 30, 2003

(30) Foreign Application Priority Data

Jul. 24, 2001 (JP) ..... 2001-222933

(51) Int. Cl.[7] ..... A45B 25/24
(52) U.S. Cl. ..... 135/34.2; 224/915
(58) Field of Search ..... 135/34.2, 25.41; 224/915

(56) References Cited

U.S. PATENT DOCUMENTS

| | | | | | |
|---|---|---|---|---|---|
| 141,151 | A | * | 7/1873 | Lusby | 135/48 |
| 337,145 | A | * | 3/1886 | Ghezzi | 135/18 |
| 428,661 | A | * | 5/1890 | Albin | 135/15.1 |
| 785,938 | A | * | 3/1905 | Epstein | 135/34.2 |
| 868,326 | A | * | 10/1907 | Casale | 135/26 |
| 892,813 | A | * | 7/1908 | Dolles | 135/25.31 |
| 925,043 | A | * | 6/1909 | Sheridan | 135/19 |
| 1,023,686 | A | * | 4/1912 | Sliggins | 135/17 |
| 1,455,410 | A | * | 5/1923 | Posselt | 135/25.41 |
| 1,587,475 | A | * | 6/1926 | Davis | 135/26 |
| 1,781,479 | A | * | 11/1930 | Schwartz | 135/25.2 |
| 1,885,968 | A | * | 11/1932 | Wedemann | 135/25.41 |
| 2,164,242 | A | * | 6/1939 | Henry | 135/34.2 |
| 2,742,913 | A | * | 4/1956 | Weisblatt | 135/34.2 |
| 3,534,752 | A | * | 10/1970 | Vanzini | 135/22 |
| 3,709,238 | A | * | 1/1973 | Leopoldi et al. | 135/15.1 |
| 4,084,600 | A | * | 4/1978 | dePolo | 135/15.1 |
| 4,350,175 | A | * | 9/1982 | DeMarco | 135/34.2 |
| 4,821,756 | A | * | 4/1989 | England | 135/19.5 |
| 4,842,003 | A | * | 6/1989 | Baldwin et al. | 135/19.5 |
| 4,962,779 | A | * | 10/1990 | Meng | 135/16 |
| 5,135,017 | A | * | 8/1992 | Fujiyama | 135/34.2 |
| 5,385,162 | A | * | 1/1995 | Wu | 135/48 |
| 5,425,388 | A | | 6/1995 | Chen et al. | |
| 6,273,111 | B1 | * | 8/2001 | Weiss et al. | 135/25.41 |
| 6,334,454 | B1 | * | 1/2002 | Williams | 135/25.41 |
| 2001/0025647 | A1 | * | 10/2001 | Chen et al. | 135/15.1 |

FOREIGN PATENT DOCUMENTS

| | | |
|---|---|---|
| GB | 2 279 004 A | 12/1994 |
| JP | 3-37005 | 2/1991 |
| JP | 8-56725 | 3/1996 |
| JP | 2676418 | 7/1997 |
| JP | 11-276223 | 10/1999 |
| JP | 2001-190314 | 7/2001 |
| NZ | 328584 | 10/1997 |

* cited by examiner

*Primary Examiner*—Robert Canfield
(74) *Attorney, Agent, or Firm*—Gerald E. Hespos; Anthony J. Casella

(57) ABSTRACT

An expansible and retractable protective cover is provided for umbrellas. The cover is mountable to align with the shaft of the umbrella and can be expanded parallel to the shaft of the umbrella to cover the umbrella after the umbrella has been folded into a closed condition. Thus, the cover contains moisture accumulated on the wet umbrella cloth from scattering.

1 Claim, 11 Drawing Sheets

PROTECTIVE COVER FOR UMBRELLAS AND UMBRELLA WITH THE PROTECTIVE COVER FIXED THERETO

BACKGROUND OF THE INVENTION

1. Field of the Invention

This invention relates to a cylindrical protective cover for umbrellas, adapted to cover an umbrella cloth as a whole and house the same therein when an umbrella is closed, and an umbrella with the same protective cover fixed thereto, and more particularly to an expansible, cylindrical protective cover for umbrellas, adapted to be fixed to a handle of an umbrella when the umbrella is in use, the protective cover being removed from the handle and fixed to a ferrule when the umbrella is closed with an umbrella cloth housed in the protective cover, the protective cover being then slid from the ferrule toward the handle and covering the umbrella cloth as a whole therewith and house the same therein, and an umbrella with the same umbrella protecting cover fixed thereto.

2. Description of the Prior Arts

When an umbrella wetted with rainwater is closed and carried as it is into the inside of a house and a car, the raindrops frequently wetted the interior thereof, caused an unexpected accident, or wetted the clothes of other person and gave the person an unpleasant feeling. In order to avoid such inconveniences, a user buys a waterproof umbrella cover and carries it with him. At an entrance of a large-sized store, for example, a department store, etc., vinyl bags are prepared, consideration is given to customers wetted umbrella so that such umbrellas are held therein.

However, when an umbrella is wetted with rainwater with the user not carrying such a waterproof holder with him, he unavoidably enters the inside of a house or a car carrying the wetted umbrella with him, so that a failure to keep a floor surface and a seat not wetted could not be avoided. Under the circumstances, so-called inversely closing umbrellas formed so that a wetted umbrella cloth thereof is not exposed to an outer surface of the umbrella have recently been proposed, and some of them have been put to practical use.

To be concrete, when a just-used umbrella is closed, free end portions of main ribs over which an umbrella cloth of the umbrella is extended are usually folded toward a handle, and the umbrella cloth extended over the main ribs is folded with a wetted surface thereof directed to the outside. However, an inversely closing umbrella is formed so that free end portions of main ribs or support ribs are reversed and folded toward a ferrule. Therefore, an umbrella cloth extended over the main ribs is folded so that a wetted outer surface thereof is directed inward. Accordingly, the wetted portion of the umbrella cloth is not positioned on an outer surface thereof.

Owing to the above-described structure, the inconveniences brought about by the wetted surface of the umbrella cloth are effectively eliminated. However, the raindrops flowing down along the main ribs or support ribs to the free end portions thereof cannot be completely stopped even when the raindrops are swished off as strongly as possible by a centrifugal force generated by shaking the umbrella. Although the outer surface of the wetted umbrella cloth is housed so as to face the inner side, the rear surfaces of the main ribs or support ribs appear partly on the outer side. Therefore, further improvements on the umbrella including measures to cover such exposed portions as mentioned above of the rear surfaces of these ribs have been demanded.

Under the circumstances, a cylindrical protective cover of an expansible structure for umbrellas, formed by telescopically connecting together a plurality of short cylinders of a resin of different diameters, fixed at a larger-diameter cylinder to a ferrule, and adapted to house an umbrella cloth as a whole therein when an umbrella is closed, by sliding the protective cover toward a handle has been proposed and put on the market. (Refer to Japanese Patent No. 2676418.)

This protective cover for umbrellas is fixed firmly to a ferrule of an umbrella, and adapted to cover an umbrella cloth as a whole therewith by sliding cylindrical fitted portions of the protective cover, and thereby protect the umbrella cloth. Therefore, a wetted umbrella cloth is completely housed in the cover, and the raindrops leaking out along the ferrule became possible to be shut off substantially completely. However, since the protective cover of this structure is fixed to the ferrule completely, the cover cannot be removed. For example, when the umbrella is inserted into and withdrawn from an umbrella stand and the like, the protective cover fixed to the portion of the umbrella which is in the vicinity of the ferrule hinders such umbrella inserting and withdrawing actions unexpectedly. Also when the umbrella is in use, the protective cover left fixed to the portion of the umbrella which is in the vicinity of the ferrule generates a large moment, and an inertial force exerts greatly on the umbrella to make a user feel that the umbrella is weightier than he expected. These have been large problems solutions of which have been hoped for.

SUMMARY OF THE INVENTION.

The present invention made so as to solve these problems provides (1) an expansible protective cover for umbrellas, adapted to house and protect, after an umbrella cloth is folded by closing a just-used umbrella, the umbrella cloth in and by the protective cover, the protective cover having the characteristic structural requirements of fixing the protective cover to a handle of the umbrella when the umbrella is in use, removing the protective cover from the handle when the umbrella cloth starts being housed therein, fixing the cover to a ferrule-side portion, and then covering the umbrella cloth as a whole and thereby housing the umbrella cloth in the protective cover.

The present invention also provides (2) a protective cover for umbrellas, having an expansible structure formed by telescopically connecting together a plurality of short cylinders of different diameters so that the protective cover is turned into a cylinder of a length large enough to cover a folded umbrella cloth as a whole when the cover is expanded, and into a short, partly frusto-conically-shaped cylinder when the cover is contracted, the protective cover having the characteristic structural requirements of forming a female thread in an inner circumferential surface of a cylinder of a minimum diameter so that the female thread is engaged with a male thread formed on one of corresponding portions of the handle and the ferrule of the umbrella.

The present invention further provides (3) a detachable function-carrying protective cover for umbrellas in accordance with the invention (2) above, which has a preferable mode of embodiment, in which, when the umbrella cloth is housed in the cylindrical umbrella protecting cover removed from the handle is engaged with the male thread provided on the ferrule-side portion with a larger-diameter cylindrical portion directed toward the handle so as to cover the folded umbrella cloth therein, the umbrella cloth as a whole being housed in the cover by sliding the protective cover toward the handle.

The present invention further provides (4) an umbrella with a protective cover fixed thereto, formed so that, when the umbrella is closed, free end portions of main ribs or support ribs over which an umbrella cloth is extended are folded toward a ferrule, the umbrella cloth being thereby folded with an outer surface thereof directed inward, the umbrella having the characteristic structural requirements of combining the protective cover with the umbrella in one body by engaging a cylindrical portion of the protective cover when a larger-diameter cylindrical portion of the cylindrical umbrella protecting cover is fixed to a handle with a male thread provided on a handle with the same cylindrical portion directed toward a ferrule; and housing the inversely folded umbrella cloth as a whole in the protective cover by sliding the protective cover as it is toward the ferrule.

The present invention also provides (5) an umbrella including a shaft rod having a ferrule provided on one end thereof, and a handle fixed to the other, a frame which is moved slidingly toward the ferrule when the umbrella is opened, and toward the handle when the umbrella is closed, and which is fitted around the shaft rod and retained thereon by a resilient locking device, a plurality of elastic support ribs connected pivotably at one end of each thereof to the frame and extended symmetrically with respect to the axis of the shaft rod, auxiliary support ribs connected pivotably at one end of each thereof to the ferrule, extended along the corresponding elastic support ribs respectively and connected pivotably at the other end of each thereof to the elastic support ribs, and an umbrella cloth extended so as to cover the outer sides of the auxiliary support ribs and elastic support ribs, the umbrella having the characteristic structural requirements of fixing a cylindrical umbrella protecting cover to a lower end of the frame in one body with a larger-diameter cylindrical portion of the cover directed toward the ferrule.

The present invention also provides (6) an umbrella including a shaft rod having a ferrule provided on one end thereof and a handle fixed to the other, a lower frame fitted around the shaft rod, and adapted to be moved slidingly to the side of the ferrule by a compression spring when the umbrella is opened, and to the side of the handle when the umbrella is closed, an upper frame fitted around the shaft rod and adapted to be moved slidingly in the vertical direction in accordance with the opening and closing of the umbrella, a plurality of main ribs which are connected pivotably at one end of each thereof to a second fulcrum provided on the upper frame, and which are extended symmetrically with respect to the axis of the shaft rod, first support ribs connected pivotably at one end of each thereof to a first fulcrum provided on the side of the ferrule, extended along the corresponding main ribs respectively and connected at the other end of each thereof to first support shafts provided on the main ribs, second support ribs connected pivotably at one end of each thereof to a third fulcrum provided on the lower frame, extended along the corresponding main ribs respectively and connected pivotably at the other end of each thereof to second support shafts provided on the portions of the main ribs which are closer to the shaft rod than to the first support shafts, and an umbrella cloth extended so as to cover the outer sides of the first support ribs and main ribs, the umbrella having the characteristic structural requirements of fixing the cylindrical umbrella protecting cover to a lower end of the lower frame with a larger-diameter cylindrical portion thereof directed toward the ferrule.

The present invention further provides (7) an umbrella including a shaft rod having a ferrule provided on one end thereof, and a handle fixed to the other, a lower frame fitted around the shaft rod, and adapted to be moved slidingly to the side of the ferrule by a compression spring when the umbrella is opened, and to the side of the handle when the umbrella is closed, an upper frame fitted around the shaft rod and adapted to be moved slidingly in the vertical direction in accordance with the opening and closing of the umbrella, a plurality of main ribs which are connected pivotably at one end of each thereof to a second fulcrum provided on the upper frame, and which are extended symmetrically with respect to the axis of the shaft rod, first support ribs connected pivotably at one end of each thereof to a first fulcrum provided on the side of the ferrule, extended along the corresponding main ribs respectively and connected at the other end of each thereof to first support shafts provided on the main ribs, second support ribs connected pivotably at one end of each thereof to a third fulcrum provided on the lower frame, extended along the corresponding main ribs respectively and connected pivotably at the other end of each thereof to second support shafts provided on the portions of the main ribs which are closer to the shaft rod than to the first support shafts, and an umbrella cloth extended so as to cover the outer sides of the first support ribs and main ribs, the umbrella having the characteristic structural requirements of fixing the cylindrical umbrella protecting cover to the portion of the handle which is close to the shaft rod with a larger-diameter cylindrical portion thereof directed toward the ferrule.

BRIEF DESCRIPTION OF THE DRAWINGS

FIGS. 12A and 12B are perspective views showing a principal portion of embodiment of the protective cover for umbrellas according to the present invention, wherein:

FIG. 12A shows an example in which a claw is made integral with a collar formed on the outermost wall of the umbrella protecting cover; and FIG. 12B shows an example in which a separately-formed movable claw is provided on the same collar.

DETAILED DESCRIPTION OF PREFERRED EMBODIMENTS

The modes of embodiment of the present invention will now be described more in detail on the basis of what are shown in the attached drawings but the present invention is not restricted thereto. The changes in design of the present invention can be made within the scope of the gist thereof.

Figure 1:
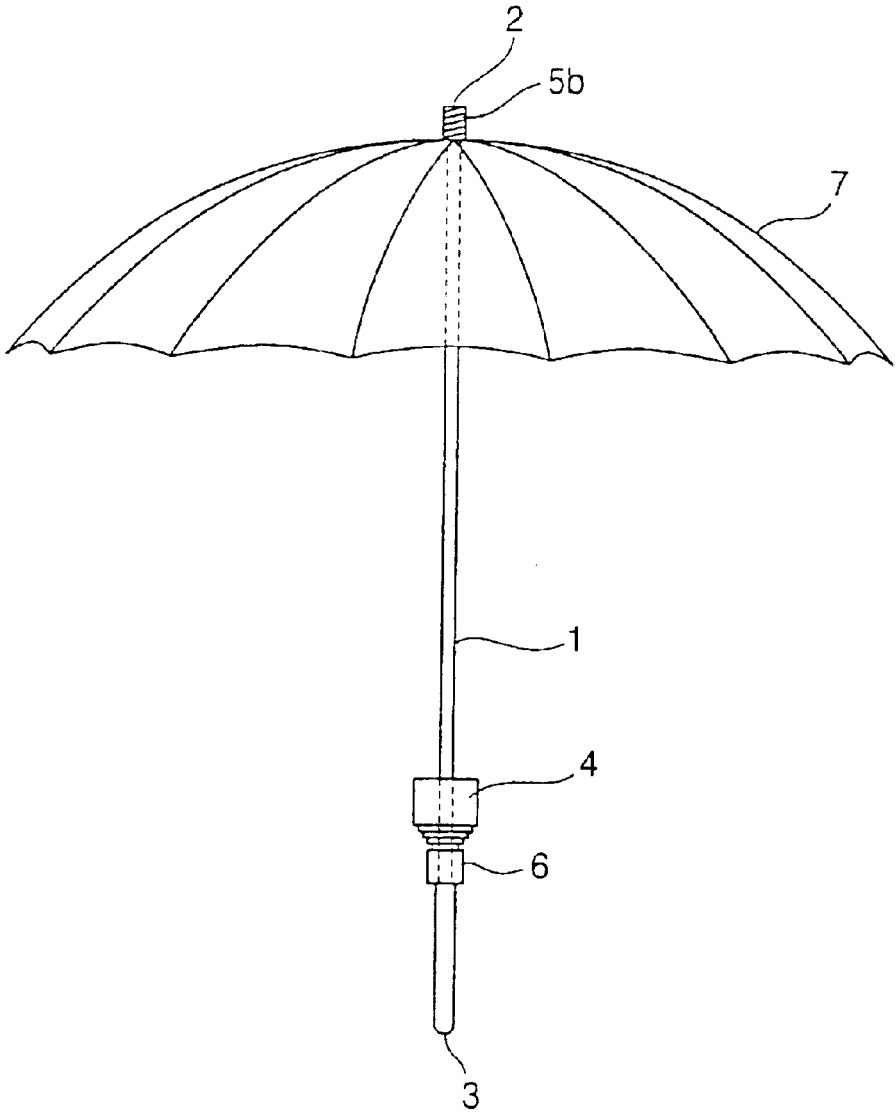
FIG. 1 is an explanatory drawing in side elevation showing a position in which the protective cover for umbrellas in an embodiment of the present invention is fixed when the umbrella is in use.
Figure 2:
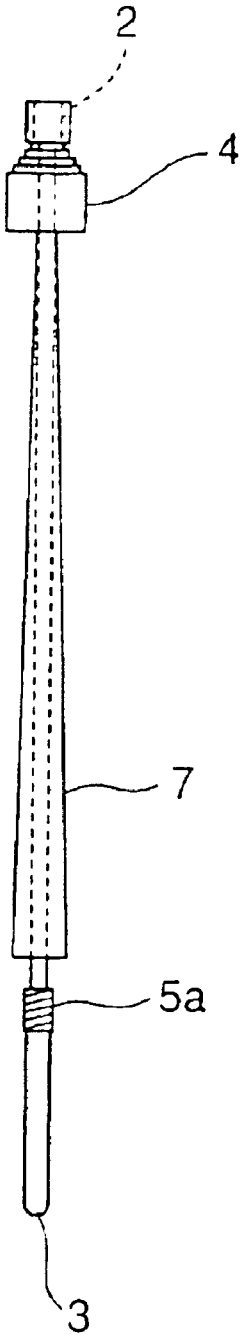
FIG. 2 is an explanatory drawing in side elevation showing the fixed condition during the closure of the umbrella of the protective cover for umbrellas in the same embodiment.

As shown in FIGS. 1 to 11, a protective cover 4 for umbrellas according to the present invention is formed by telescopically connecting together a plurality of short cylinders of different diameters. The protective cover 4 has an expansible and cylindrical structure changed into a cylinder of a length large enough to cover an umbrella cloth as a whole as shown in FIGS. 3, 4, 7, 9 and 11 when the cover is expanded, and into a short, partly frusto-conically shaped cylinder as shown in FIGS. 1, 2, 6, 8 and 10 when the cover is contracted. In the cylindrical protective cover 4 for umbrellas, a female thread is provided in an inner circumferential surface of a cylinder of the smallest diameter, and formed so that the female thread is disengageably engaged with male threads 5*a*, 5*b* formed on corresponding portions of a handle 3 and a ferrule 2 of the umbrella. This protective cover 4 is normally fixed to the handle 3 of the umbrella with the cover directed as shown in FIG. 1. When the cover is fixed to the ferrule 2 of the umbrella, the cover is removed from the handle 3 and fixed with the cover directed as shown in FIG. 2.

Figure 3:
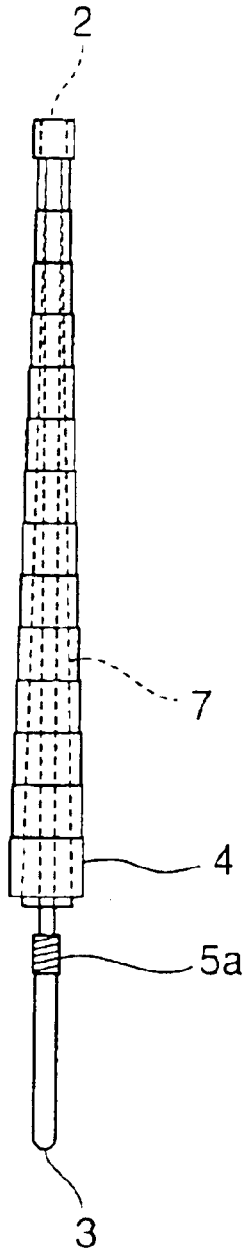
FIG. 3 is an explanatory drawing in side elevation showing the condition of use of the protective cover for umbrellas during the closure of the umbrella in the same embodiment.

A mode of embodiment of a first invention in this application will be described more concretely on the basis of what are shown in FIGS. 1 to 3. A shaft rod 1 is provided with a ferrule 2 on one end thereof, and a handle 3, which is used to hold the umbrella, on the other. Male threads 5*a*, 5*b* are formed on the portions of the ferrule 2 and handle 3 which are close to the shaft rod 1. In order to open and use the umbrella, the female thread 6 of the cover 4 for protecting a contracted umbrella is engaged with the male thread 5*a* provided on the side of the handle 3 as shown in FIG. 1. After the umbrella which has been used is closed with an umbrella cloth folded, the umbrella protecting cover 4 removed from the male thread 5*a* of the handle 3 is engaged with the male thread 5*b* , which is provided on the side of the ferrule 2, as shown in FIG. 2 with a larger-diameter cylindrical portion directed toward the handle 3. The cylindrical portion of the umbrella protecting cover 4 is then slid toward the handle 3 to complete the housing of the umbrella cloth as a whole in the umbrella protecting cover 4 as shown in FIG. 3.

Figure 4:
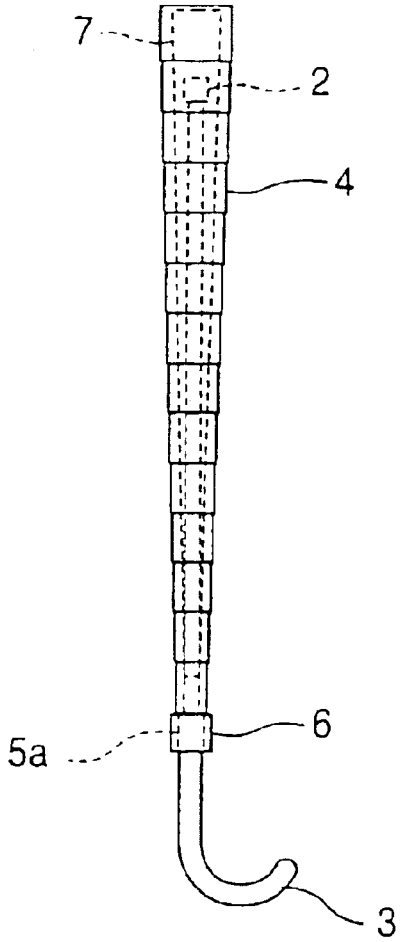
FIG. 4 is an explanatory drawing in side elevation showing the condition of use of the protective cover for umbrellas in one embodiment of another invention in this application.

A mode of embodiment of another invention in this application will be described on the basis of what are shown in FIG. 4. A female thread 6 of an umbrella protecting cover 4 is engaged with a male thread 5*a* provided on the portion of a handle 3 which is close to a shaft rod 1 with a larger-diameter cylindrical portion of the protective cover directed to a ferrule 2. The free end portions of main ribs 7 of the just-used umbrella are folded toward the ferrule 2 to thereby fold an umbrella cloth with an outer surface thereof directed inward. A cylindrical portion of the umbrella protecting cover 4 is then slid toward the ferrule 2 to complete the housing of the umbrella cloth as a whole in the umbrella protecting cover 4 as shown in FIG. 4. Thus, the protection of the umbrella cloth in a so-called inversely closing umbrella is completed.

The umbrella protecting cover 4 in the present invention made of a resin is usually preferably used. Various other kinds of materials, such as a light aluminum alloy can also be used selectively as long as these materials have a considerable degree of mechanical strength, small weight and excellent processability. Since the umbrella protecting cover 4 according to the present invention is formed detachably by employing a screwing system, the protective cover is moved in one with an umbrella but the present invention does not necessarily stick to such a structure. A structure of the umbrella protecting cover 4 formed so that the cover itself is put in another holder, i.e. a bag and the like and transported can also be selected freely.

The protective cover 4 for umbrellas in the above mode of embodiment of the present invention is an expansible umbrella protecting cover 4 adapted to hold an umbrella as a whole which has just been used and closed with an umbrella cloth foldedtherein. This protective cover is formed as a detachable umbrella protecting cover 4 fixed to a handle 3 of an umbrella when the umbrella is in use, and removed from the handle when the housing of the umbrella cloth therein is done, fixed to the side of a ferrule 2, the covering and housing of the umbrella cloth therewith and therein being thereafter done. Therefore, an umbrella having this umbrella protecting cover enables the working of moment during the opening and use of the umbrella to be reduced, a sense of weightiness of the umbrella caused by an inertial force thereof to be eliminated, and a sense of comfort of use of the umbrella to be obtained as compared with a known umbrella in which a protective cover is fixed to a ferrule thereof. The protective cover fixed to the ferrule hampers the inserting and withdrawing of the umbrella into and from an umbrella stand. However, the protective cover for umbrellas according to the present invention employs a detachable system, so that such inconveniences can be prevented.

Figure 5:
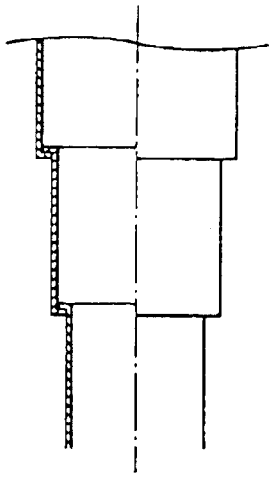
FIG. 5 is an enlarged explanatory drawing for describing the fitted condition of members of the cylindrical protective cover for umbrellas according to the present invention.

Furthermore, the umbrella protecting cover 4 in the above-described mode of embodiment of the present invention has an expansible structure as shown in FIG. 5, which is formed by telescopically connecting together a plurality of short cylinders of different diameters so that the protective cover is turned into a cylinder long enough to cover a folded umbrella cloth as a whole when the protective cover is expanded, and into a short, partly frusto-conically shaped cylinder when the protective cover is contracted. A female thread is formed in an inner circumferential surface of a cylinder of the smallest diameter so that the female thread can be disengageably engaged with the male threads formed on corresponding portions of the handle and ferrule of the umbrella.

The protective cover 4 for umbrellas according to the first invention in this application has a preferable mode of embodiment in which, when a just-used umbrella is closed with the umbrella cloth thereby housed in the cylindrical detachable type umbrella protecting cover 4, the protective cover is removed from the handle and engaged with the male screw 5*b* having on the side of the ferrule 2 the larger-diameter cylindrical portion directed toward the handle 3, covers the folded umbrella cloth therewith, and is slid toward the handle 3 to thereby house the umbrella cloth as a whole therein. Therefore, the operation for housing the umbrella cloth in the detachable type umbrella protecting cover can be carried out by a so-called one button-pressing action, so that the scattering of raindrops on the user's hands and arranged objects therearound can be prevented. The umbrella according to another invention in this application is a so-called inversely closing umbrella formed so that, when the umbrella is closed, the free end portions of main ribs 7 over which an umbrella cloth is extended are folded toward a ferrule 2 with an umbrella cloth thereby folded with an outer surface thereof directed inward. When the cylindrical umbrella protecting cover is fixed to a handle 3, a larger-diameter cylindrical portion thereof is engaged with the ferrule 2, and the protective cover 4 is slid as it is toward the ferrule 2. As a result, the umbrella cloth as a whole folded in the inverse direction can be housed in the protective cover 4, so that the housing of the umbrella cloth in the cover can be completed literally by one button-pressing action in the same manner as mentioned above.

Figure 6:
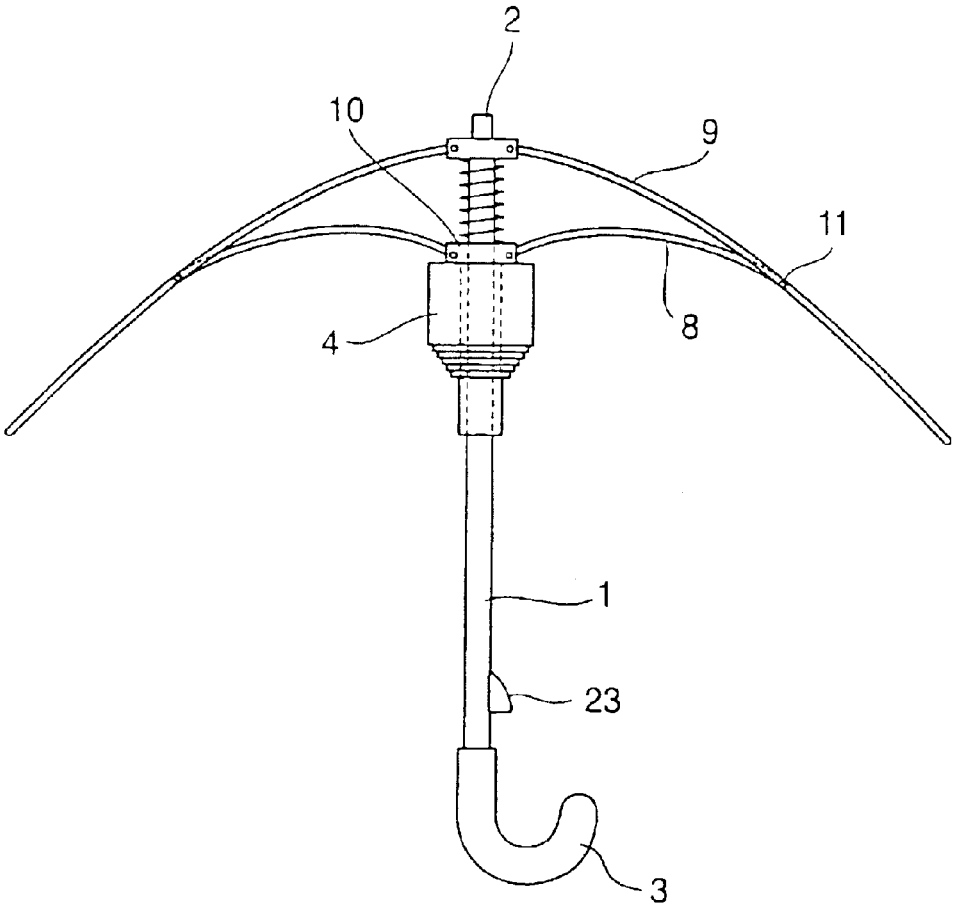
FIG. 6 is an explanatory drawing in side elevation showing a position in which the protective cover for umbrellas is fixed in an embodiment of still another invention in this application.
Figure 7:
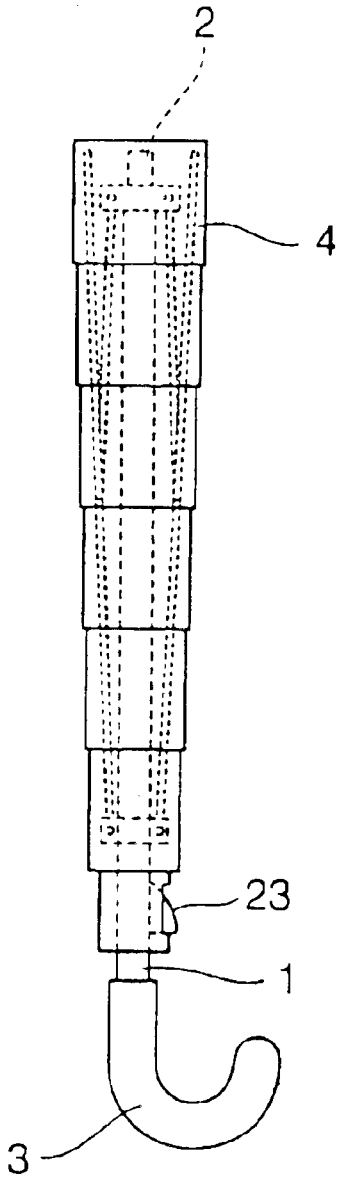
FIG. 7 is an explanatory drawing in side elevation showing the condition of the same embodiment in which the umbrella is closed with the protective cover therefor used.
Figure 8:
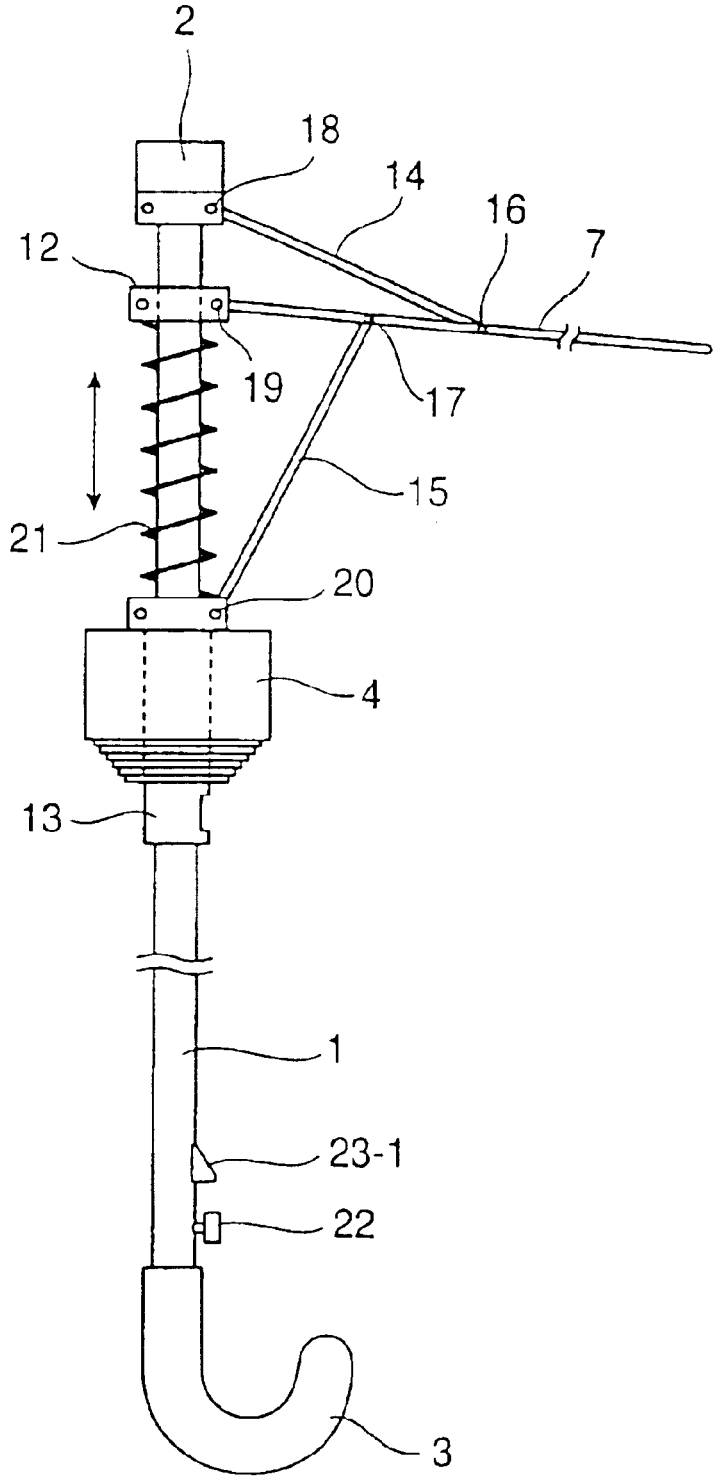
FIG. 8 is an explanatory drawing in side elevation showing a position in which the protective cover for umbrellas is fixed with an umbrella opened in an embodiment of a further invention in this application.

In a mode of embodiment of still another invention in the present application, an umbrella protecting cover 4 is fixed to a frame 10 of a so-called inversely closing umbrella so that the protective cover 4 and frame are in one body as shown in FIG. 6. The umbrella according to this invention includes a shaft rod 1 having a ferrule 2 fixed to one end thereof and a handle 3 fixed to the other, a frame 10 fitted around the shaft rod 1 and retained thereon by a resilient locking device, and adapted to be moved slidingly toward the ferrule 2 when the umbrella is opened, and toward the handle 3 when the umbrella is closed, a plurality of elastic support ribs 8 connected pivotably at one end of each thereof to the frame 10 and extended symmetrically with respect to the axis of the shaft rod 1, auxiliary support ribs 9 connected pivotably at one end of each thereof to the ferrule 2, extended along the corresponding elastic support ribs 8 respectively and connected pivotably at the other end of each thereof to the elastic support ribs 8, and an umbrella cloth extended so as to cover the outer sides of the auxiliary support ribs 9 and elastic support ribs 8, the cylindrical umbrella protecting cover 4 being fixed to a lower end of the frame 10 with a larger-diameter cylindrical portion thereof directed toward the ferrule.

When the umbrella having the above-described structure is opened and used in practice, the umbrella protecting cover 4 is slidingly moved toward the ferrule 2 in accordance with the movement of the frame 10, and the umbrella is kept opened owing to the elasticity of the ribs and tension of the umbrella cloth. When the umbrella is closed, the frame 10 is slidingly moved with the cover 4 toward the handle 3, and held by the locking member 23 supported on the resilient locking device. During this time, the elastic support ribs 8 are reversed around the support shafts 11 in accordance with the downward movement of the frame 10, and closed so that outer ends thereof approach the ferrule 2, the umbrella cloth extended so as to cover the outer sides of the auxiliary support ribs 9 and elastic support ribs 8 being folded substantially in the shape of the letter "W" with the outer side thereof directed inward. The cylindrical umbrella protecting cover 4 is then slid toward the ferrule 2 to complete the operation for housing the umbrella cloth in the protective cover 4. A device for fixing the umbrella protecting cover 4 to the frame 10 in this mode of embodiment is preferably made by employing threads as in the previously-described invention. An engagement structure utilizing annular recess and projection, a fixing structure utilizing rivets and a bonding agent and other similar structure can be freely selected.

Since this mode of embodiment is formed so that, when the umbrella is opened, the protective cover 4 is fixed to the frame 10 in one body. Therefore, an umbrella cloth housing operation is simplified. Not only a fear that the user's hands be wetted with the raindrops is eliminated but also the umbrella cloth housing operation is carried out pleasantly. Moreover, when the umbrella cloth housing operation of the protective cover 4 is completed, the overall length of the umbrella including the protective cover 4 decreases, i.e., the umbrella cloth can be housed compactly.

In a mode of embodiment of a further invention in this application, a so-called inversely closing umbrella is formed by providing the same with a jumping function using a one push-button pressing action with the same umbrella protecting cover. 4 as mentioned above fixed thereto in one body. To be concrete, this umbrella includes a shaft rod 1 having a ferrule 2 on one end thereof and a handle 3 on the other, a lower frame 13 fitted around the shaft rod 1 and adapted to be moved slidingly toward the ferrule 2 when the umbrella is opened, and toward the handle 3 when the umbrella is closed, an upper frame 12 fitted around the shaft rod 1 and adapted to be moved vertically in accordance with the opening and closing of the umbrella, a plurality of main ribs 7' which are connected pivotably at one end of each thereof to a second fulcrum 19 provided on the upper frame 12, and which are extended symmetrically with respect to the axis of the shaft rod 1, first support ribs 14 connected pivotably at one end of each thereof to a first fulcrum 18 provided on the side of the ferrule 2, extended along the corresponding main ribs 7', and connected pivotably at the other end of each thereof to first support shafts 16 provided on the main ribs 7', second support ribs 15 connected pivotably at one end of each thereof to the third fulcrum 20 provided on the lower frame 13, extended along the corresponding main ribs 7', and connected pivotably at the other end of each thereof to second support shafts 17 provided on the portions of the main ribs 7' which are closer to the shaft rod 1 than to the first support shafts 16, and an umbrella cloth extended so as to cover the outer sides of the first support ribs 14 and main ribs 7', the umbrella having as preferable structural requirements of fixing the cylindrical umbrella protecting cover 4 to a lower end of the lower frame 13 with a larger-diameter cylindrical portion thereof directed toward the ferrule 2.

Figure 9:
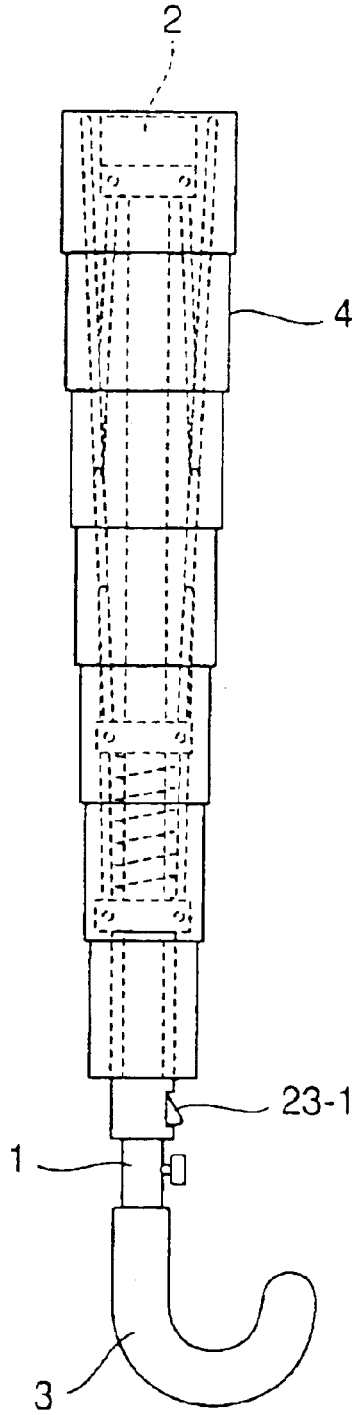
FIG. 9 is an explanatory drawing in side elevation showing the condition of the same embodiment in which the umbrella is closed with the protective cover therefor used.

The umbrella in the above mode of embodiment is designed so that a locking member 23-1 operatively connected to an operating button 22 provided on the portion of the shaft rod 1 which is in the vicinity of the handle 3, and urged by a resilient locking device is projected from and retracted into the shaft rod 1 by an operation of the operating button 22. When the closed umbrella is opened, the umbrella protecting cover 4 is slid toward the handle 3 and contracted, and the operating button 22 is pressed to hold the locking member 23-1 in the interior of the shaft rod 1. At the same time, the lower frame 13 is slidingly moved toward the ferrule 2 owing to the resilient force of the coiled spring 21 with a final manual raising force to retain an opened state of the umbrella. When the umbrella is closed, the above operations are carried out reversely. This enables a desired object to be achieved. In this mode of embodiment, the jumping function thereof based on a one push-button pressing action made by the coiled spring is fulfilled only for a so-called initial operation, and finally, the opening and closing of the umbrella are completed by a manual operation. The housing and protecting of the umbrella cloth in and by the protective cover 4 are completed as shown in FIG. 9, by closing the umbrella and sliding the protective cover 4 toward the ferrule 2.

Figure 10:
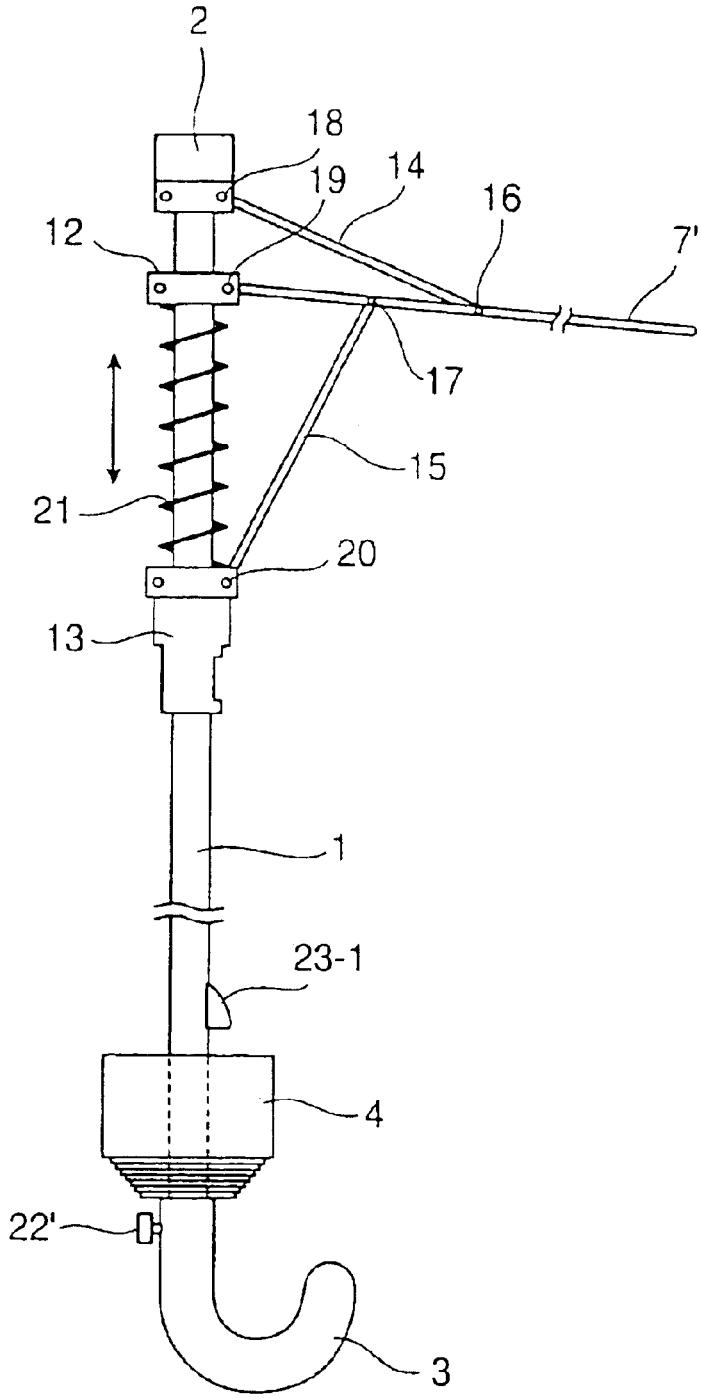
FIG. 10 is an explanatory drawing in side elevation showing a position in which the protective cover for umbrellas is fixed with an umbrella opened in an embodiment of another invention in this application.
Figure 11:
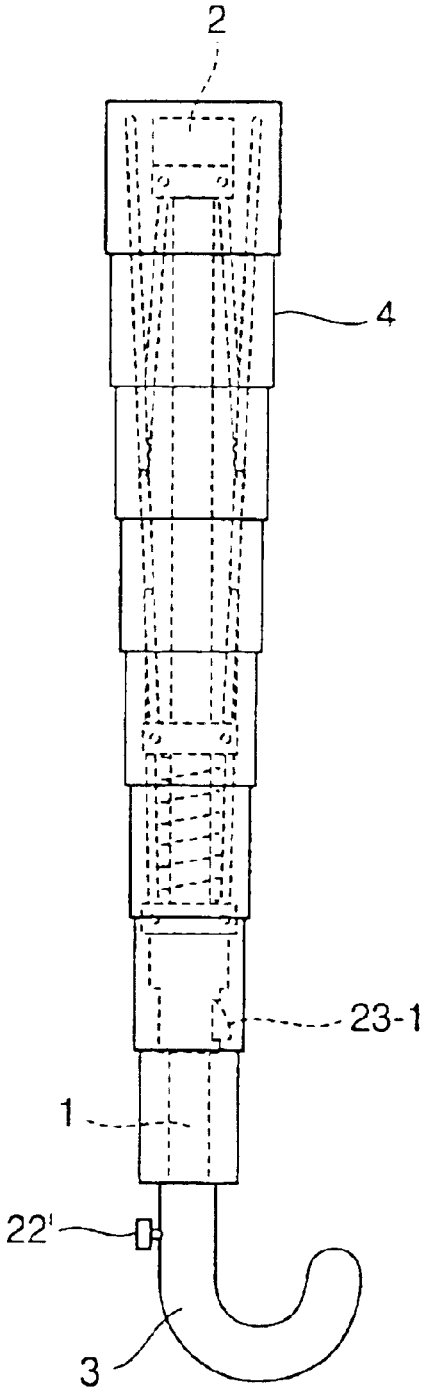
FIG. 11 is an explanatory drawing in side elevation showing the condition of the same embodiment in which the umbrella is closed with the protective cover therefor used.

A mode of embodiment of another invention in this application is substantially identical with that of the above-described invention except that a position in which an umbrella protecting cover 4 is fixed is set on a handle 3 which is shifted downward from a lower frame 13 as shown in FIG. 10. Namely, the embodiment of FIG. 10 is formed by fixing the umbrella protecting cover 4 to the portion of the handle 3 of a one push-button pressing jumping function-carrying inversely closing umbrella which is close to a shaft rod 1 with a larger-diameter cylindrical portion directed toward a ferrule 2. In accordance with this arrangement, a position in which an operating button 22' is provided is shifted to an upper portion of the handle 3 as shown in FIGS. 10 and 11, so as to prevent the umbrella protecting cover 4 from interfering with the same.

In the modes of embodiment of these two inventions, carrying out an extremely simple operation for merely sliding the protective cover 4 fixed to the lower frame 13 or handle 3 toward the ferrule 2 after closing the umbrella which has been used and folding the umbrella cloth as well as fulfilling the one push-button pressing jumping function concerning the opening and closing of the umbrella by pressing the operating button 22 or 22' completes the housing of the umbrella cloth in the protective cover 4 substantially simultaneously with the closing of the umbrella.

Figure 12A:
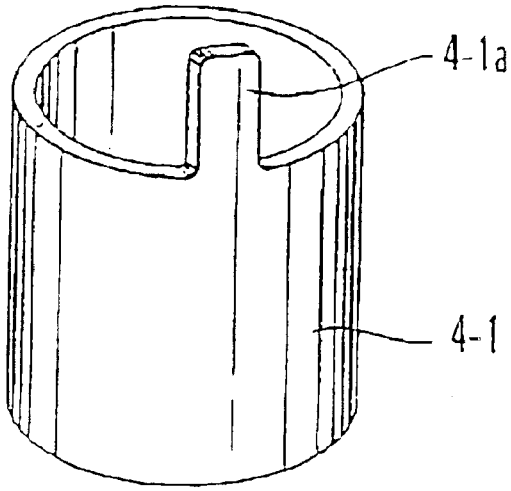
Figure 12B:
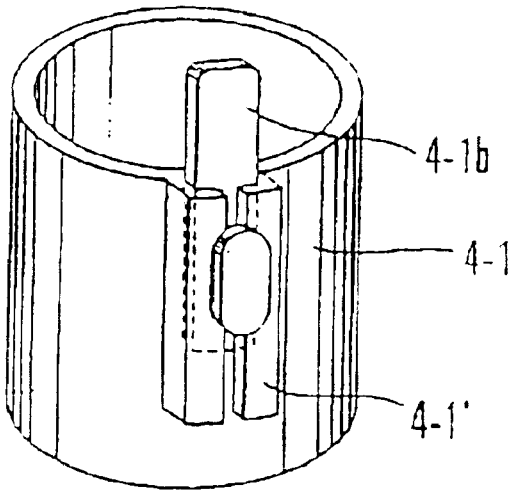

In order to easily house the umbrella cloth in the protecting cover while winding the umbrella cloth, an integral type claw 4-1*a* or a separately-formed type movable claw 4-1*b* can be provided on a collar 4-1 of the outermost wall of the umbrella protecting cover 4 as shown in FIGS. 12A and 12B. The separately-formed type movable claw 4-1*b* is slidably fitted in hook-shaped rails 4-1' provided in a side surface of the collar 4-1 as shown in the drawing.

When a claw is provided on the collar 4-1 of the outermost wall of the umbrella protecting cover, the umbrella cloth can be housed in the protective cover simply and speedily since the claw 4-1*a* or 4-1*b* works as a guide while the umbrella cloth is wound around the claw and housed in the protective cover as the collar 4-1 is relatively turned.

As described in detail above, the protective cover for umbrellas according to the inventions (1) to (3) above in this application employs a detachable structure. Therefore, the protective cover, which was always fixed to the side of the ferrule in a related art umbrella, is provided on the side of a handle while an umbrella is opened and used. Accordingly, the operation of moment ascribed to the protective cover fixed to the side of the ferrule, and a sense of weightiness ascribed to the effect of the inertial force of the moment are prevented, and a sense of comfort of use is ensured. Moreover, since the protective cover for umbrellas according to these inventions is of a detachable type, the cover can be stored separately from the umbrella, so that the condition of use of an umbrella with the protective cover not fixed thereto can be experienced if desired.

In the invention (4) in this application, the umbrella protecting cover is screwed on the handle portion of a so-called inversely-closing type umbrella with the larger-diameter cylindrical portion of the cover directed toward the ferrule, the cover being thereby fixed to the handle in one body. Therefore, an operation for housing the umbrella cloth in the protective cover can be carried out only by sliding the umbrella protecting cover toward the hand. Accordingly, the umbrella cloth housing operation is completed very simply and smoothly.

The invention (5) in this application relates to an umbrella of the type in which the umbrella cloth extended so as to cover the outer sides of the elastic support ribs and auxiliary ribs is reversed in accordance with the vertical movement of the frame to which the elastic support ribs are pivotably connected. In this umbrella, the umbrella protecting cover is fixed to the frame in one body, and this enables an umbrella cloth housing operation, which is carried out after the just-used umbrella is closed, to be completed smoothly without causing the hands of a user to be wetted, the length of the umbrella as a whole to be reduced to a required minimum level, and the umbrella cloth to be housed compactly.

The inventions (6) and (7) in this application relate to an inversely closing type umbrella to which a so-called one push-button pressing jumping function is added. The invention (6) has a structure formed by fixing the umbrella protecting cover to the lower frame in one body which has support ribs connected pivotably thereto, and which is moved up and down slidingly and thereby controls the opening and closing of the umbrella. The invention (7) has a structure formed by fixing the umbrella protecting cover to the handle in one body. These structures enable the opening and closing of the umbrella and the housing of the umbrella cloth in the protective cover to be completed substantially at the same time, the length of the umbrella as a whole to be reduced to a very low level in the same manner as in the previously-described inventions, and the weight of the umbrella to be reduced noticeably owing to the simple structure.

Moreover, the cylindrical umbrella protecting cover according to these inventions can be applied to even a regular type umbrella or a so-called inversely closing type umbrella substantially equally by merely changing the cover fixing position in the vertical direction, and the housing of the umbrella cloth as a whole in the protective cover by a one push-button pressing action can be done smoothly.

In addition, when a so-called inversely closing type umbrella is closed after the umbrella is used, the main ribs are reversed and closed, and the umbrella cloth is folded at the same time with the wetted outer surface thereof directed inward. However, this umbrella cloth folding operation causes the parts of the rear sides of the main ribs to be exposed to view, and this problem has been left unsolved. The umbrella protecting cover according to the present invention covers and houses the umbrella cloth as a whole, so that this protective cover can solve even such a problem effectively. Moreover, the inversely closing type protective cover-carrying umbrella according to the present invention can be stood up even in an inversely closed state on its dew guide tips or protective cover.

The umbrella having an umbrella protecting cover fixed thereto according to the present invention is not specially limited with respect to the structure as an umbrella, i.e., the umbrella may be formed arbitrarily in the scope of the invention in which the objects of the invention are met, and the structure of the umbrella can be freely selected.

What is claimed is:

1. An umbrella characterized by comprising a shaft rod having a ferrule provided on one end thereof, and a handle fixed to the other, a frame which is moved slidingly toward the ferrule when the umbrella is opened, and toward the handle when the umbrella is closed, and which is fitted around the shaft rod and retained thereon by a resilient locking device, a plurality of elastic support ribs connected pivotably at one end of each thereof to the frame and extended symmetrically with respect to the axis of the shaft rod, auxiliary support ribs connected pivotably at one end of each thereof to the ferrule, extended along the corresponding elastic support ribs respectively and connected pivotably at the other end of each thereof to the elastic support ribs, and an umbrella cloth extended so as to cover the outer sides of the auxiliary support ribs and elastic support ribs, an umbrella protecting cover being fixed to a lower end of the frame and having a plurality of short cylinders of different diameters telescopically connected together with a larger-diameter short cylinder of the cover directed toward the ferrule so that the protective cover is expandable into a long conical shape having sufficient dimension for covering the folded umbrella cloth in each rib, and wherein the projective cover is collapsible into a short frusto-conical shape adjacent the lower end of the frame when the umbrella is open.

* * * * *